US005524355A

United States Patent [19]

Schiel et al.

[11] Patent Number: 5,524,355

[45] Date of Patent: Jun. 11, 1996

[54] METHOD AND DEVICE FOR THE TRANSPORT OF A LIQUID-GAS MIXTURE IN A PAPER MAKING MACHINE

[75] Inventors: Christian Schiel; Marc-Oliver Stenitschka, both of Heidenheim, Germany

[73] Assignee: Voith Sulzer Papiermaschinen GmbH, Heidenheim, Germany

[21] Appl. No.: 374,935

[22] Filed: Jan. 18, 1995

[30] Foreign Application Priority Data

Jan. 20, 1994 [DE] Germany ..... 44 01 582.8

[51] Int. Cl.[6] ..... F26B 13/08; D06F 58/00

[52] U.S. Cl. ..... 34/119; 34/124; 34/125; 165/90

[58] Field of Search ..... 34/124, 125, 119; 165/89, 90

[56] References Cited

U.S. PATENT DOCUMENTS

| | | | |
|---|---|---|---|
| 2,885,790 | 5/1959 | Cram | 34/119 |
| 2,893,136 | 7/1959 | Justus et al. | 34/119 |
| 2,993,282 | 7/1961 | Daane et al. | 34/125 |
| 3,280,987 | 3/1965 | Steinbock | 206/394 X |
| 4,122,945 | 10/1978 | Borzak . | |
| 4,384,412 | 5/1983 | Chance et al. | 34/119 |
| 4,491,222 | 1/1985 | Gaccetta et al. . | |
| 4,516,334 | 5/1985 | Wanke | 34/119 |
| 4,606,136 | 8/1986 | Pflug | 34/119 |
| 4,708,246 | 11/1987 | Minion | 209/394 |
| 4,718,177 | 1/1988 | Haeszner et al. | 34/119 |
| 4,734,229 | 8/1988 | Johnson et al. | 165/89 |
| 4,883,178 | 11/1989 | Thiele et al. | 206/391 |
| 4,924,603 | 5/1990 | Wolf | 165/90 |
| 4,988,410 | 1/1991 | Meinecke et al. | 162/360.1 |
| 5,020,243 | 6/1991 | Miller et al. | 34/119 |
| 5,045,153 | 9/1991 | Sollinger et al. | 162/301 |
| 5,086,919 | 2/1992 | Toral et al. | 206/394 X |
| 5,090,135 | 2/1992 | Wolf et al. | 34/124 |
| 5,165,542 | 11/1992 | Sommerfeldt et al. | 206/394 |
| 5,405,101 | 4/1995 | Toral et al. | 242/600 |

FOREIGN PATENT DOCUMENTS

| | | |
|---|---|---|
| 236215 | 10/1964 | Austria . |
| 81 04939 | 3/1981 | France . |
| 641717 | 8/1937 | Germany . |
| 7620143 | 10/1976 | Germany . |
| 3404125 | 8/1985 | Germany . |
| 3535315 | 4/1986 | Germany . |
| 3815278 | 11/1989 | Germany . |
| 4005420 | 8/1991 | Germany . |
| 4023871 | 2/1992 | Germany . |
| 4232361 | 3/1994 | Germany . |
| 4337944 | 5/1994 | Germany . |
| 3256790 | 10/1988 | Japan . |
| 2031834 | 4/1980 | United Kingdom . |
| 8002187 | 10/1980 | WIPO . |

*Primary Examiner*—John M. Sollecito
*Assistant Examiner*—Steve Gravini
*Attorney, Agent, or Firm*—Marshall, O'Toole, Gerstein, Murray & Borun

[57] ABSTRACT

A method and device for the continuous transport of a liquid-gas mixture from an inlet reservoir having a first liquid level to a discharge chamber having a second liquid level includes a suction tube connecting the inlet reservoir and the discharge chamber, a gas separator disposed in the suction tube, and a conduit through which a gas passes to the second liquid level.

11 Claims, 3 Drawing Sheets

METHOD AND DEVICE FOR THE TRANSPORT OF A LIQUID-GAS MIXTURE IN A PAPER MAKING MACHINE

BACKGROUND OF THE INVENTION

1. Field of the Invention

The invention relates to methods and devices for the transport of a liquid-gas mixture from an inlet to an outlet, and in particular to methods and devices utilizing a suction line that connects inlet and outlet chambers.

2. Description of Related Technology

Devices for the continuous transport of a liquid-gas mixture from an inlet chamber to a discharge chamber having a suction line connecting the inlet and discharge chambers are utilized in the paper making industry. For example, in steam-heated dryer cylinders of paper machines, condensate from an inner space of the cylinder can be removed therefrom with the aid of a syphon.

In such a paper machine cylinder, a certain amount of liquid must be transported from an inlet, which is at a first liquid level, to an outlet, which is at a second liquid level. At the same time, a certain amount of gas is transported together with the liquid. The gas transport may not be intended and may be undesirable.

When a syphon is utilized in a rotating dryer cylinder of a paper making machine, the syphon tube with its aspirating connection is immersed into condensate which forms on an inner wall of the dryer cylinder as an annular film. As long as the suction connection is below the condensate level, it is possible to remove condensate at a constant throughput (amount per unit time). However, since the thickness of the condensate film during the operation of the paper machine varies, the suction connection of the syphon might not always be fully immersed into the condensate. As a result, vapor (steam) as well as condensate is removed from the cylinder through the syphon. When gas flows through the syphon together with the liquid, the flow behavior becomes erratic. The larger the proportion of the gas, the larger the throughput of transported liquid because the gas entrains liquid with it as it flows through the syphon. However, since the amount of gas available in the inlet chamber is limited, the pressure in the inlet chamber drops very quickly, so that, due to a lack of pressure difference, liquid is no longer transported. At the same time, the thickness of the annular condensate film begins to grow again, so that the suction connection of the syphon is again immersed into the condensate and the cycle begins again. When two parallel syphons are used to remove condensate from a dryer cylinder, a situation readily occurs in which one syphon transports a large gas throughput while condensate flows through the second syphon.

Thus, in order to remove condensate from steam-heated rotating dryer cylinders of paper making machines, and to achieve stable, uninterrupted condensate flow, large amounts of steam have been allowed to flow through the syphon, together with condensate. The volumetric ratio of the steam throughput to condensate throughput must typically exceed the value of 50 in order to ensure a stable condensate flow.

It is known that bores disposed above the syphon suction connection can be provided through which additional steam can be introduced in order to avoid complete breakdown of the condensate stream. However, the bores for additional steam must be of a relatively large cross-section in order to provide the desired effect. When using such additional steam bores, a low ratio of steam throughput to condensate throughput cannot be achieved.

SUMMARY OF THE INVENTION

It is an object of the invention to overcome one or more of the problems described above. It is also an object of the invention to provide a method and a device with which, when transporting liquid-gas mixtures from a first to a second level, stable flow conditions can be created with a minimum gas content and substantially without pulsations. Moreover, it is an object of the invention to provide a syphoning method which, even in the case of several parallel suction tubes, ensures that all the suction tubes transport liquid as long as liquid is supplied at the suction tube inlet.

According to the invention, a method for the continuous transport of a liquid/gas stream from a first location having a first liquid level to a second location having a second liquid level includes the steps of separating gas from the liquid-gas stream in a path located between the first level and the second level; guiding the gas to a space above the second level; separating a main liquid stream from the liquid-gas stream at a separation region; guiding the liquid-gas stream in a liquid-gas column to a level above the separation region; and providing a pressure difference between a space disposed above the liquid-gas column and the space above the second level.

A device according to the invention for the continuous transport of a liquid-gas mixture from an inlet reservoir having a first liquid level to a discharge chamber having a second liquid level includes a suction tube connecting the inlet reservoir and the discharge chamber, a gas separator disposed in the suction tube, and a conduit through which a gas passes to the second liquid level.

Other objects and advantages of the invention will be apparent to those skilled in the art from the following detailed description taken in conjunction with the drawings and the appended claims.

DETAILED DESCRIPTION OF THE INVENTION

Figure 1:
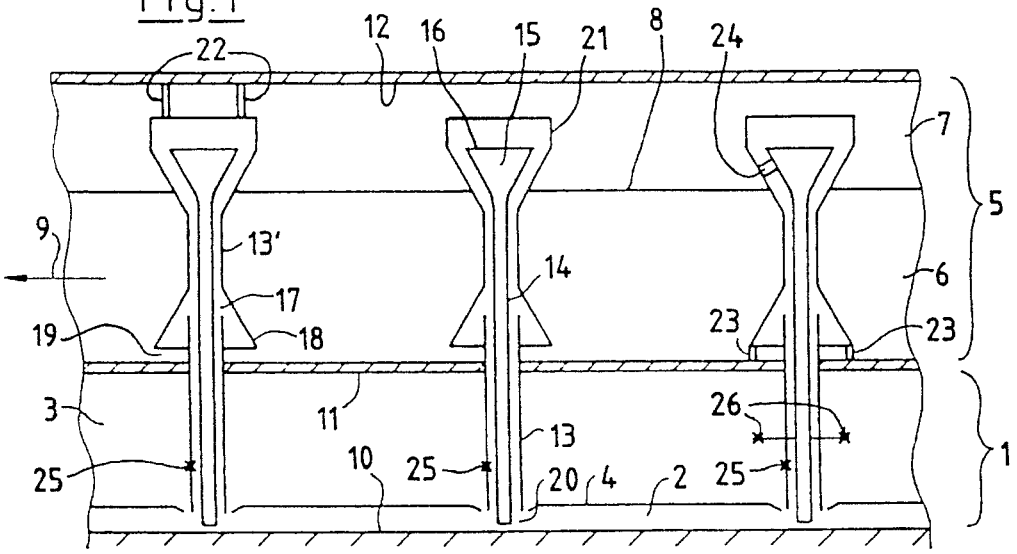
FIG. 1 is a longitudinal sectional view of a plurality of devices according to the invention.

FIG. 1 illustrates a device according to the invention. An apparatus in which a device according to the invention is disposed has an inlet chamber or reservoir 1 partially filled with a liquid 2 and a space 3 partially filled with a gas. The surface of the liquid 2 is at a level 4. A discharge chamber 5 of the apparatus is also partially filled with a liquid 6 and includes a space 7 partially filled with a gas. The liquid located in the discharge chamber 5 has a level 8. The inlet flow of liquid into the inlet chamber 1 is not shown. The inlet flow can be, for example, continuous and can enter the chamber in a direction perpendicular to the plane of the drawing, Liquid is removed continuously from the chamber 5 in a direction indicated by an arrow 9. The apparatus includes a floor 10 of the inlet chamber 1, a separating wall 11 and a cover 12. The wall 11 separates the inlet chamber 1 from the discharge chamber 5. According to the invention, the chambers 1 and 5 are only connected to each other by suction tubes 13 and liquid return tubes 14. A pressure difference exists between the gas spaces 3 and 7. This is approximately equal to the geodetic difference of the liquid levels 4 and 5. In order to maintain the pressure difference between the two gas spaces, means such as fans are used (not shown in FIG. 1; see FIG. 4 element 40) or other means are used.

Above the liquid level 8, the liquid return tubes 14 have an inlet funnel 15 with an overflow edge 16. The individual suction tubes 13 each have a slit 17. An extension piece 13' is connected to each suction tube 13 above the slit 17. The extension piece 13' has a funnel-shaped extension 18 at its lower end, having an open end 19 at a bottom thereof. The extension 18 serves as a gas separator or screen and prevents gas from passing together with the liquid through the slit 17 and also through the gas separator 18 into the discharge chamber 6. The separation of liquid and gas bubbles in the gas separator 18 occurs by rising of the gas in the liquid. From the liquid-gas mixture that flows from the suction tube 13, the gas bubbles enter through the slit 17 into the extension piece 13' and thus entrain liquid in an upward direction.

When the proportion of gas in the liquid-gas mixture exceeds a certain value, the level of the liquid-gas mixture column in the extension piece 13' reaches the overflow edge 16 of the inlet funnel 15, so that liquid flows through the inlet funnel 15 and through the return tube 14 back to the liquid 2 in the inlet chamber 1.

The upper region of the extension piece 13' is also designed as a funnel 21 and rises above the overflow edge 16 of the inlet funnel 15. The funnel 21 is open at a top thereof and communicates with the gas space 7 of the discharge chamber 5. The only extension piece 13' is secured either with posts 22 to the cover 12 or with posts 23 to the separating wall 11. These two types of posts can be used together. The return tubes 14 are also held in the suction tubes 13, 13', for example, with crosspieces 24 and screws 26, The walls of the suction tubes 13 are provided with bores or nozzles 25 for entry of additional gas. The bores communicate with air disposed above the inlet reservoir and preferably have a diameter smaller than 10% of a diameter of the suction tube.

In FIGS. 2 to 9, certain elements of the devices identified in these figures that function identically or similarly to the elements discussed herein with respect to FIG. 1 are identified by the same reference numerals used in FIG. 1 with the exception that a letter, a, b, c, etc. is placed after the number. For example, the reference numerals 1, 1*b*, and 1*c*, all identify a chamber or space partially filled with a liquid 2, 2*b*, and 2*c*, respectively.

Figure 2:
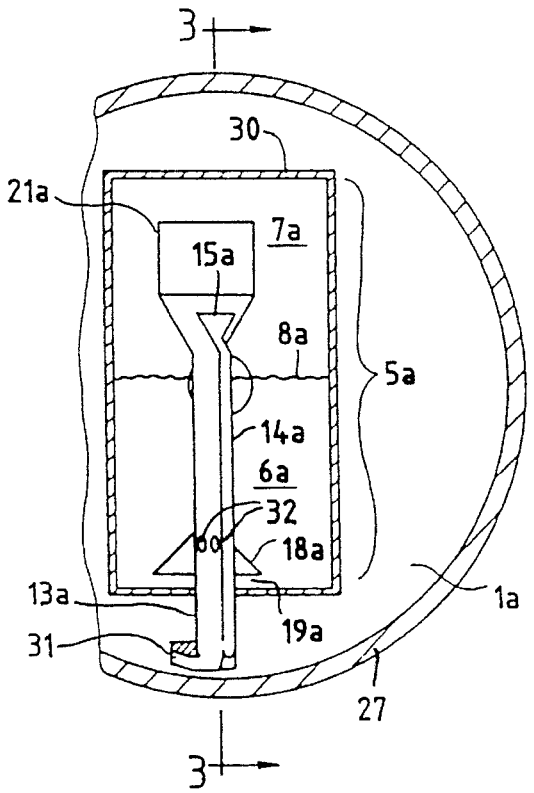
FIG. 2 is a cross-sectional view of a second embodiment of a device according to the invention.
Figure 3:
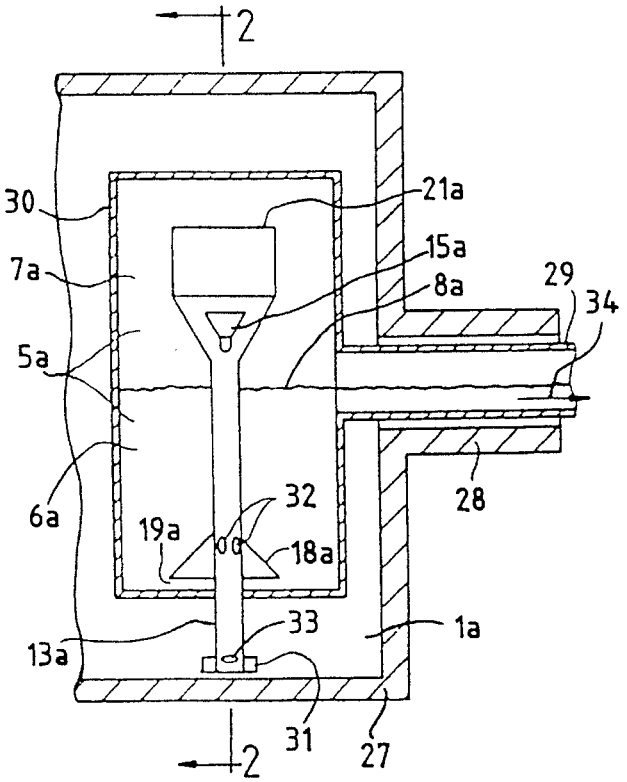
FIG. 3 is a sectional view taken along the line III—III of FIG. 2.

FIG. 2 shows an embodiment of a device according to the invention in cross-section and taken along a plane perpendicular to an axis of a paper machine dryer cylinder 27 in which the inventive device is disposed. FIG. 3 is a cross-sectional view of the device shown in FIG. 2 taken along a plane parallel to the axis of the dryer cylinder 27. FIGS. 2 and 3 show a portion of the cylinder 27 of a dryer section of a paper machine (not shown). The cylinder 27 is rotatably supported by bearing journals 28.

In FIGS. 2 and 3, an inlet chamber 1*a* is defined by an inner surface of the cylinder 27. A discharge chamber 30 is disposed within the inlet chamber la and a stay tube 29 is connected to the discharge chamber 30. The tube 29 extends through the bearing journals 28 and outside of the cylinder 27. An inner chamber 5*a* contains liquid 6*a* as well as gas 7*a*, separated by a liquid level 8*a*.

A liquid-gas mixture arrives continuously in a suction tube 13*a*. The liquid is water formed by condensation and gas in the form of water vapor. The water/gas mixture is introduced into the suction tube 13*a* through an inlet tip 31 located at a lower end of the tube 13*a*. In the lower region of the discharge chamber 5*a*, there is a gas separator 18*a* communicating with the inside of the suction tube 13*a* through bores 32 in the tube 13*a*. The gas separator 18*a* is open at a bottom thereof so that an inner space defined by the separator 18*a* communicates with the liquid 6*a*. The suction tube 13*a* includes a funnel 21*a* at an upper end thereof. The funnel 21*a* is open at a top thereof.

Similar to the embodiment of the invention shown in FIG. 1 having a tube 14, a liquid return tube 14*a* is provided in the embodiment shown in FIGS. 2 and 3. The tube 14*a* has a funnel 15*a* at an upper end thereof. The funnel 15*a* is located above the funnel 21*a* and has an opening 33 at a lower end thereof. The liquid-gas mixture flowing into the suction tube 13*a* is transported into the discharge chamber 5*a* for removal in a direction indicated by an arrow 34 in FIG. 3. The stay tube 29 is held outside the bearing journals 28 in the paper machine frame (not shown) concentrically to the bearing journals 28.

The device according to the invention shown in FIGS. 2 and 3 operates in the same way as described herein with respect to the embodiment shown in FIG. 1. When the level of the liquid-gas mixture reaches the upper edge of the small funnel 15*a*, liquid enters into the funnel 15*a* and thus into the return tube 14*a* and flows back to the inlet chamber 1*a*. Thus, a constant flow of liquid in the upward direction is ensured in the tube 13*a* having a constant low gas content.

Figure 4:
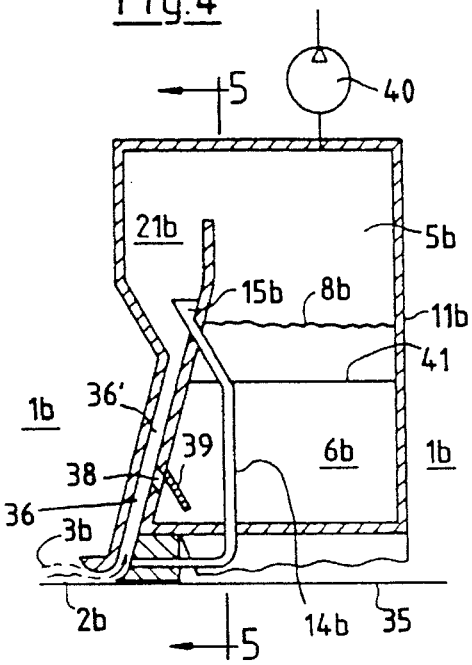
FIG. 4 is a cross-sectional view of a third embodiment of a device according to the invention.
Figure 5:
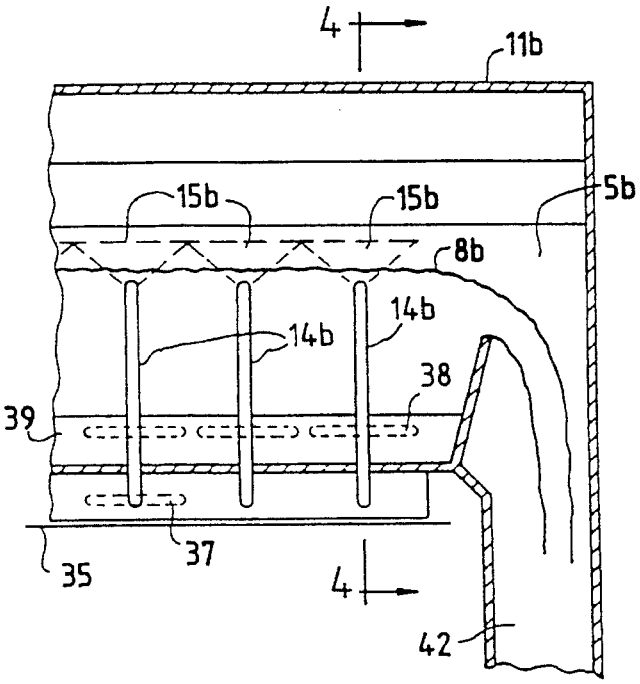
FIG. 5 is a sectional view taken along the line V—V of FIG. 4.

FIG. 4 is a cross-sectional view of an embodiment of a device according to the invention taken along a plane perpendicular to an endless belt, also known as a wire 35 of a paper machine. The view of the device shown in FIG. 4 is taken in a direction of movement of the wire 35. FIG. 5 is a cross-sectional view of the device of FIG. 4 taken along a plane running perpendicular to the paper machine wire 35 and transverse to the direction of movement of the paper machine wire 35.

In the embodiment of a device according to the invention shown in FIGS. 4 and 5, the paper machine wire 35 moves from left to right as shown in FIG. 4. An inlet chamber or reservoir 1*b* is defined by free space disposed outside of an outlet chamber 5*b*. The chamber 1*b* is at atmospheric pressure. A housing wall 11*b* encloses the outlet chamber 5*b*. A liquid layer 2*b* is disposed on the paper machine belt or wire 35 and is the filtrate of a fiber suspension. An air layer 3*b* is above the liquid layer 2*b*. The air layer 3*b* is entrained by the liquid layer 2*b*. The two layers arrive into a suction channel 36, 36' that has a slit-like inlet gap at a lower end thereof. The suction channel 36, 36' extends over a transporting width of the belt or wire 35 as either a single section or in several sections, each of which uses only a part of the width of the belt or wire 35.

The suction channel 36, 36' has an extension 21*b* at a top thereof. There are several inlet funnels 15*b* of small dimension within the extension 21*b*. The funnels 15*b* are connected to an inlet region of the suction channel 36 via liquid return tubes 14*b*. The return tubes 14*b* open into a slit nozzle 37 at a bottom thereof. The slit nozzle 37 is wider than a diameter of an individual tube 14*b*.

In a lower portion of the suction channel 36, 36' located below a liquid level 8*b*, the suction channel 36, 36' is connected with the discharge chamber 5*b* via bores or slits 38 in the walls defining the channel 36, 36'. Liquid can flow through the bores 38 from the suction channel 36 to the discharge chamber 5*b*. Aprons 39 attached to the wall of the channel 36, 36' are disposed in the region of the bores 38. The aprons 39 function as air separators and prevent the entry of air through the bores 38 into a liquid portion 6*b* of the discharge chamber 5*b*. As a results the air layer 3*b* entrained with the liquid layer 2*b* is forced to rise in the suction channel 36' all the way to the funnel 21*b*. The level of fluid in the funnel 21*b*, however, cannot rise substantially above upper edges of the small funnel 15*b*; rather, liquid flows from the upper edges of the small funnel 15*b* down into the funnel 15*b*, through the lines 14*b*, and back to the inlet of the suction channel 36.

A fan 40 is connected to the discharge chamber 5*b* and ensures a necessary pressure difference between the funnel 21*b* and the inlet slit of the suction channel 36. A discharge channel 42 (see FIG. 5) has a syphon connection through which only water can leave, but no air can progress in a direction against the water flow.

Figure 6:
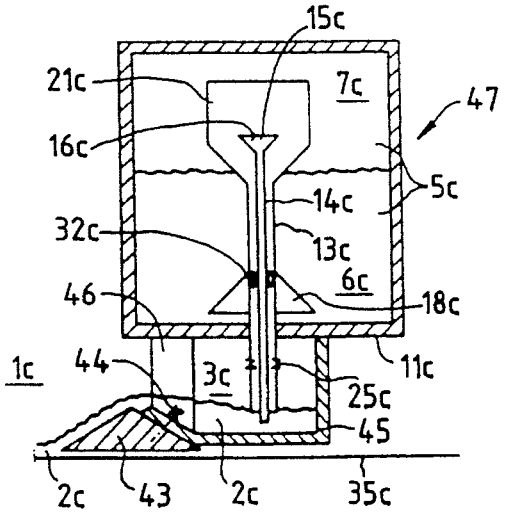
FIG. 6 is a cross-sectional view of a fourth embodiment of a device according to the invention.

FIG. 6 shows a device according to the invention also utilized with a paper machine wire 35*c*. The view of the device shown in FIG. 6 is taken along a plane disposed perpendicular to the paper machine wire 35*c* and perpendicular to the direction of movement of the wire.

In the embodiment of the invention shown in FIG. 6, an inlet reservoir or space 1*c* is defined by free space disposed outside of an outlet chamber 5*c* similar to the space 1*b* described herein with respect to FIGS. 4 and 5. A water or liquid layer 2*c* is introduced on the belt or wire 35*c* which moves from left to right in the figure. When the water layer 2*c* reaches an inlet of a suction tube 13*c*, the layer 2*c* is lifted from the wire 35*c* by a coating strip 43 so that a certain liquid back-up is achieved in an inlet trough 45. The coating strip 43 is secured with screws 44 on the inlet trough 45. The inlet trough 45 has longitudinal ribs 46 in its inlet region. The ribs 46 are attached directly to the inner wall 11*c* of a container, generally 47 within which a discharge chamber 5*c* is disposed.

The suction tube 13*c* aspirates liquid and air and transports both liquid and air into the discharge chamber 5*c*. The liquid arrives directly through openings 32*c* as well as through an air separator 18*c* into liquid 6*c* in the chamber 5*c*. On the other hand, the air continues to rise in the suction tube 13*c* and arrives through a funnel 21*c*, which is open at a top thereof, and then into air space 7*c* of discharge chamber 5*c*. If the level in the funnel 21*c* continues to rise sufficiently, then water will arrive through an upper edge 16*c* into the small funnel 15*c* and through a return line 14*c* and again to the inlet of the suction tubes 13*c*.

Figure 7:
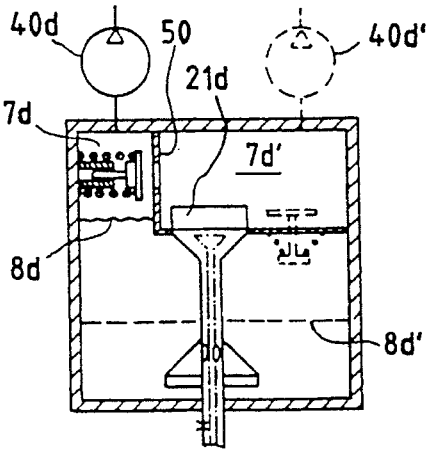
FIG. 7 is a cross-sectional view of a fifth embodiment of a device according to the invention and shown with a partitioned discharge chamber.

An embodiment of a device according to the invention shown in FIG. 7 is a variation of the embodiment shown in FIG. 6. As can be seen, in this embodiment, two air spaces 7*d* and 7*d'* are created by a separating wall 50. FIG. 7 illustrates alternative pressure situations that can occur in the two air spaces 7*d* and 7*d'*. The gas pressure may be higher in the space 7*d'* than in the space 7*d* and therefore a liquid level 8*d* rises (see left side of the drawing) as a result of the increased pressure in the discharge space 7*d'* or is decreased to 8*d'* (shown in phantom) due to a lower pressure in the space 7*d'*. Any desired pressure difference can be adjusted between the spaces 7*d* and 7*d'*, for example, with the aid of spring-loaded valves.

Figure 8:
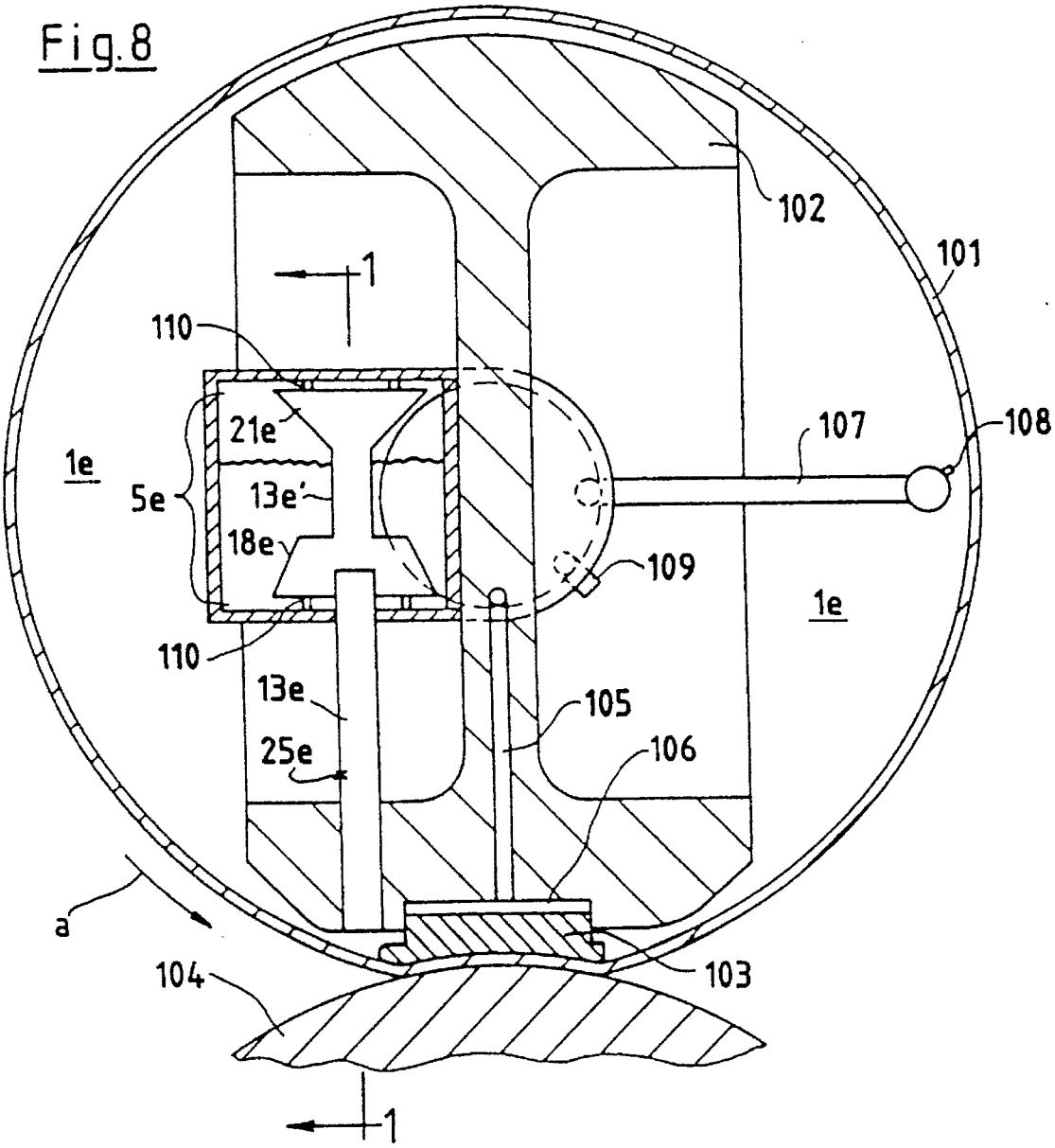
FIG. 8 is a cross-sectional view of a sixth embodiment of a device according to the invention shown with a pressure roll.

FIG. 8 shows a cross-sectional view of an embodiment of a device according to the invention with a pressure roll having a rotating surface and a fixed axis, the view being taken along a plane perpendicular to the axis. In the embodiment of a device according to the invention shown in FIG. 8, a flexible pressing mantle 101 of the pressure roll, which is impervious to liquids, moves around in a direction indicated by an arrow a. The pressing mantle 101 is sealed hermetically on front faces thereof with the aid of co-rotating sealing disks (not shown). The device shown in FIG. 8 includes a stationary supporting girder 102 disposed inside the mantle 101. The girder 102 is supported outside the sealing disks (not shown) by a frame (not shown). A glide shoe 103 having a concave surface presses the pressing mantle 101 against a pressure roll 104. A paper web can be guided between the pressing mantle 101 and the pressure roll 104, together with continuous belts or wires which enclose the paper web in a sandwich-like manner. However, this is not shown.

Through a conduit or line 105, a pressure medium arrives to a top side of the glide shoe 103. This shoe 103 glides in a recess 106 of the supporting girder 102 at a bottom thereof and applies a pressing pressure against the pressing mantle 101. Through another conduit or line 107, as well as through nozzles 108, cooling and lubricating fluid arrives to the inside of the pressing mantle 101. These agents, which are applied in excess, are removed to a location outside of the mantle 101 by a suction tube 13*e* and are cooled. The suction tube 13*e* cools the fluids and provides a conducting connection between an inner chamber 1*e* of the pressing mantle 101 and a discharge chamber 5*e*. From the discharge chamber 5*e*, through a hollow journal of the supporting girder 102, the liquid is transported outside the mantle 101. The transport of the liquid is supported with air, which is blown into the inner chamber 1*e* through a conduit or line 109.

An extension piece 13*e'* with an air separator 18*e* and a funnel 21*e* is provided in the device shown in FIG. 8. The extension piece 13*e'* is held on a housing wall 11*e* with the aid of posts 110.

Figure 9:
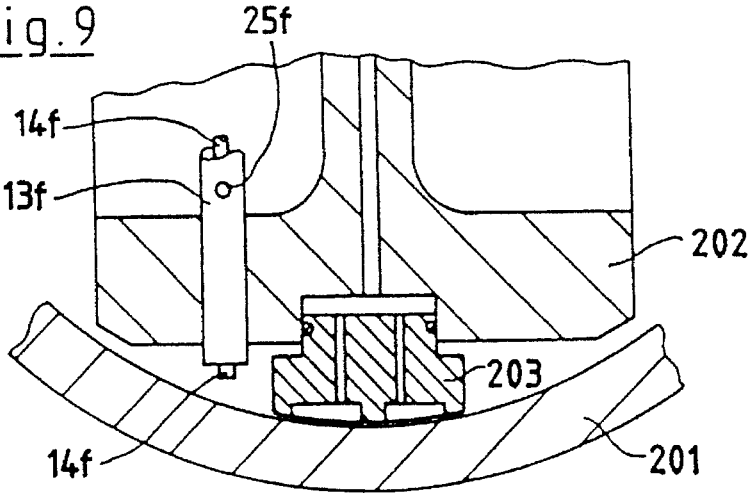
FIG. 9 is a cross-sectional view of an seventh embodiment of a device according to the invention shown with a pressure roll.

FIG. 9 shows an alternative embodiment to FIG. 8. FIG. 9 is a cross-sectional view of a device according to the invention shown with a pressure roll having a rotating surface and a fixed axis, the view being taken along a plane perpendicular to the axis. The view shows a rigid pressure roll mantle 201, which is pressed by a hydrostatic shoe 203. The hydrostatic shoe 203 is slidingly guided in a transverse girder 202 and can be pressed down against the pressure roll mantle 201. Aspiration is performed by a suction tube 13*f*, into which return tubes 14f are placed. The longitudinal suction I—I corresponds to FIG. 1.

The foregoing detailed description is given for clearness of understanding only, and no unnecessary limitations should be understood therefrom, as modifications within the scope of the invention will be apparent to those skilled in the art.

We claim:

1. A method for continuous transport of a liquid/gas mixture from a first location having a first liquid level to a second location having a second liquid level, said method comprising the steps of:

separating gas from a liquid-gas stream in a path located between the first level and the second level;

guiding the gas to a space above the second level;

separating a main liquid stream from the liquid-gas stream at a separation region;

guiding the liquid-gas stream in a liquid-gas column to a level above the separation region; and providing a pressure difference between a space disposed above the liquid-gas column and the space above the second level, the pressure above the liquid-gas column being higher than the pressure above the second liquid level.

2. The method of claim 1 wherein the pressure above the liquid-gas column is lower than that above the second liquid level.

3. The method of claim 1 wherein a returned partial stream is introduced to a space above the first liquid level.

4. A device for continuous transport of a liquid-gas mixture from an inlet reservoir having a first liquid level to a discharge chamber having a second liquid level, said device comprising:

a suction tube connecting the inlet reservoir and the discharge chamber;

a gas separator disposed in the suction tube;

a conduit through which a gas passes to the second liquid level; and an overflow apparatus for returning liquid to the inlet reservoir, said overflow apparatus disposed the conduit.

5. The device of claim 4 wherein the suction tube has openings and is limited by the gas separator by preventing gas from passing together with liquid through the suction tube, said gas separator being connected to the suction tube above said openings and being open at a bottom thereof.

6. The device of claim 4 wherein the gas separator is disposed below the second liquid level and has a lower end communicating with the discharge chamber and an upper end communicating with the suction tube.

7. The device of claim 4 wherein the suction tube has an extended portion in the shape of a funnel at an upper end thereof.

8. The device of claim 7 wherein the extended portion of the suction tube is disposed adjacent the second liquid level.

9. The device of claim 4 wherein the suction tube extends from the inlet reservoir to liquid disposed in the discharge chamber, said suction tube having an extension piece connected to the suction tube, the suction tube and extension piece defining a slit therebetween, the extension piece having a lower end in the form of a funnel that widens in a downward direction.

10. The device of claim 4 disposed in the vicinity of an endless belt of a paper machine, and wherein the suction tube has a slitted cross-section extending in a direction transverse to a direction of movement of the belt.

11. The device of claim 4 wherein the suction tube has holes communicating with air disposed above the inlet reservoir, said holes having a diameter smaller than 10% of a diameter of the suction tube.

* * * * *